US005944879A

United States Patent [19]

Martyak

[11] Patent Number: 5,944,879

[45] Date of Patent: Aug. 31, 1999

[54] NICKEL HYPOPHOSPHITE SOLUTIONS CONTAINING INCREASED NICKEL CONCENTRATION

[75] Inventor: Nicholas M. Martyak, Doylestown, Pa.

[73] Assignee: Elf Atochem North America, Inc., Philadelphia, Pa.

[21] Appl. No.: 09/003,275

[22] Filed: Jan. 6, 1998

Related U.S. Application Data

[60] Provisional application No. 60/038,627, Feb. 19, 1997.

[51] Int. Cl.[6] ..... C23C 18/36

[52] U.S. Cl. ..... 106/1.22; 106/1.27

[58] Field of Search ..... 106/1.22, 1.27

[56] References Cited

U.S. PATENT DOCUMENTS

| | | | |
|---|---|---|---|
| 3,658,569 | 4/1972 | Philipp et al. | 117/47 |
| 3,876,434 | 4/1975 | Dutkewych et al. | 106/1.22 |
| 4,125,648 | 11/1978 | Vratny | 427/305 |
| 4,299,888 | 11/1981 | Pickart et al. | 428/457 |
| 4,483,711 | 11/1984 | Harbulak et al. | 106/1.22 |
| 4,840,820 | 6/1989 | Schultz et al. | 427/305 |
| 5,258,061 | 11/1993 | Martyak et al. | 106/1.27 |
| 5,269,838 | 12/1993 | Inoue et al. | 106/1.22 |
| 5,336,391 | 8/1994 | Rice | 205/152 |
| 5,419,821 | 5/1995 | Vaughan | 204/182.4 |
| 5,522,972 | 6/1996 | Nobel et al. | 205/488 |
| 5,718,745 | 2/1998 | Itoh et al. | 106/1.22 |

*Primary Examiner*—Helene Klemanski

*Attorney, Agent, or Firm*—Stanley A. Marcus; Gilbert W. Rudman

[57] ABSTRACT

This invention relates to aqueous solutions containing Ni cation and hypophosphite anion which have a Ni cation concentration greater than 36 grams/liter. Such solutions have utility in electroless nickel plating baths and processes as make-up solutions and replenishing solutions. The increased concentration of Ni cation results from the addition of the nickel salt of an alkyl sulfonic acid to the solution.

10 Claims, No Drawings

NICKEL HYPOPHOSPHITE SOLUTIONS CONTAINING INCREASED NICKEL CONCENTRATION

REFERENCE TO RELATED APPLICATIONS

This application claims the benefit of U.S. Provisional Application Serial No. 60/038,627, filed Feb. 19, 1997.

BACKGROUND OF THE INVENTION

1. Field of the Invention

This invention relates to solutions of nickel hypophosphite having an increased nickel concentration. In one embodiment, the invention relates to make-up and replenishing solutions for electroless nickel baths that utilize nickel hypophosphite, the solutions having a nickel ion concentration above 36 grams per liter.

2. Description of the Prior Art

Nickel hypophosphite solutions are known, as is their use in electroless nickel baths for depositing nickel or a nickel alloy onto a substrate.

Electroless nickel plating is a widely utilized plating process which provides a continuous deposit of a nickel metal or alloy coating on metallic or non metallic substrates without the need for an external electric plating current.

Electroless nickel plating is described generally as a controlled autocatalytic chemical reduction process for depositing the desired nickel metal and is simply achieved by immersion of the desired substrate into an aqueous plating solution under appropriate electroless plating conditions.

In conducting electroless nickel plating, particularly from a bath which utilizes a hypophosphite as the reducing agent, the bath basically contains a source of nickel cations, usually nickel sulfate, and a hypophosphite reducing agent, usually sodium hypophosphite. The deposition reaction takes place in the bath and generally involves the reduction of a nickel cation to form a nickel metal alloy as a deposit on the desired substrate surface. The reduction reaction is generally represented by the following equation:

$$3H_2PO_2^- + Ni + 2 \rightarrow 3/2H_2\uparrow + H^+ + 2HPO_3^{-2} + P + Ni^o$$

As the reaction continues the by-products and bath conditions created thereby present problems which adversely affect the desired plating process.

These problems include the buildup of the anion of the nickel salt employed to maintain the optimum nickel concentration, typically sulfate, as well as the increased concentration of extraneous sodium cations, from the use, of example, of sodium hydroxide to adjust the pH and sodium hypophosphite to replace the hypophosphite. This build-up or increase in the concentration of such anions and cations as they accumulate in the bath produces a deleterious effect on the plating reaction and adversely affects the quality of the plating deposited on the substrates. The accumulation of ionic species in the bath degrades the quality of the nickel deposit and makes it unacceptable for such high-level applications as hard discs for computers, as well as CD-ROM and other optical disc storage. Further, the anions adversely affect the bath by causing the bath to become unacceptable at low levels of metal turnover, i.e., the number of times that the original nickel source is replenished. Thus the accumulation of added sodium cations and sulfates prevents the long-term and economical use of the expensive plating solutions and adversely affects the nickel deposit.

To address these problems, it has been proposed to use nickel hypophosphite as the source of both nickel and hypophosphite in the bath.

For example, Nobel, et al., in U.S. Pat. No. 5,522,972 disclose that nickel hypophosphite is useful in the formulation of electroless nickel plating baths, particularly since one can eliminate both sodium and sulfate ions to give the bath longer life. Nobel, et al., disclose a method for preparing nickel hypophosphite by contacting a nickel anode with a solution containing hypophosphite ions and applying a current to dissolve the nickel into the solution and form a nickel hypophosphite solution.

This approach has the advantage that no extraneous ions are introduced into the bath. Since there is no sulfate ion in the bath there is no formation of sludge when orthophosphite is removed by precipitation with calcium. Also, since no sodium is introduced into the bath, the bath remains free of undesirable ionic species. However, the poor solubility of nickel metal in hypophosphorous acid—35 grams per liter at saturation—leads to problems because a considerable amount of nickel hypophosphite solution must be added to the plating tank to maintain the desired amount of nickel ion in the bath. At present, in standard electroless nickel systems using nickel sulfate as the nickel source, a make-up and replenishment solution is used that contains from about 75 to 100 grams per liter of nickel. Because of the low solubility of nickel in hypophorous acid—35 grams per liter at saturation, one must add a considerably greater volume of a nickel hypophosphite solution than nickel sulfate solution to the plating tank to maintain the desired amount of nickel ion in the bath. The large volume of nickel hypophosphite solution needed causes the tank to quickly fill to capacity and sometimes causes the electroless nickel solution to actually spill over the top of the vessel.

Another problems resulting from the large replenishment volumes required is that the operating temperature of the bath is rapidly changed. This, in turn, causes a change in the phosphorous content of the electroless nickel deposit and, therefore, significant variability in the quality of the deposit; the phosphorous content of the deposit increases with reduced temperature. In operation, a large replenishment could drop the operating temperature from 90° C. to 85° C. or less and it could take 10 minutes or more for the temperature to climb back to 90° C., at which time another replenishment might be required.

It would be useful in connection with the various processes that utilize nickel hypophosphite, particularly with electroless nickel solutions, to have a solution with a nickel concentration above 35 grams per liter.

SUMMARY OF THE INVENTION

It has now been discovered that the concentration of nickel ion in a nickel phosphite solution can be increased to be greater than 36 gram per liter by the addition of the nickel salt of an alkyl sulfonic acid, such as nickel methanesulfonate.

The use of the composition of this invention in an electroless bath (a) eliminates the presence of sulfate, (b) eliminates the introduction of an extraneous cation with the hypophosphite, (c) permits the formation of low-stress nickel alloy deposits and (d) allows a continued high rate of plating with as many as 30 or more metal turnovers, in comparison to baths containing sulfate anion which makes it difficult to operate such electroless nickel baths for more than about 7 metal turnovers.

DETAILED DESCRIPTION OF THE INVENTION

In one aspect this invention relates to novel solutions for use in electroless nickel plating baths.

In yet another embodiment, this invention relates to the use in an electroless nickel plating process of a solution of a nickel hypophosphite salt having a $Ni^{+2}$ concentration above 36 grams/liter, preferably above 40 grams/liter, more preferably above 50 grams/liter, most preferably above 60 grams/liter.

In yet another aspect, this invention relates to solutions for use in electroless nickel baths, the solutions containing nickel cation and both hypophosphite and alkyl sulfonate anions. In one embodiment, the invention relates to makeup solutions and solutions used to replenish nickel and hypophosphite in such baths.

The invention which is related to electroless nickel baths employing a hypophosphite reducing agent and operated under electroless nickel conditions comprises, in one embodiment incorporating a solution of (a) nickel salts of hypophosphorous acid and (b) nickel salts of an alkyl sulfonic acid into an electroless nickel bath.

These and other aspects of the invention will be apparent from the following detailed description.

During electroless nickel deposition, orthophosphite is formed. The orthophosphite content of the bath must be controlled. One way is by the use of an alkali metal or alkaline earth metal compound, which is soluble in the replenishing solution or bath but which forms an insoluble orthophosphite salt. By way of illustration, the alkali metal and alkaline earth metal compounds can be the oxides, hydroxides and carbonates of lithium, potassium, magnesium, barium and/or calcium. In order to avoid introducing extraneous ions into the bath, the alkali metal or alkaline earth metal cation can be introduced as the hypophosphite salt and in the preferred embodiment calcium hypophosphite is added to the solution or bath; the calcium from the hypophosphite is available to react with the orthophosphite present in the bath. Thus, there are no undesired ions introduced into the bath and the stress of the nickel alloy deposit is minimized. Alternatively, one can add the alkali metal or alkaline earth metal cation partly or completely as the salt of an alkyl monosulfonic acid or alkyl polysulfonic acid. These sulfonic acids are described in detail below in connection with the nickel salt. For example, part or all of the calcium hypophosphite can be replaced by calcium methanesulfonate, which is soluble. In such case the hypophosphite can be supplied as hypophosphorous acid. Further, when one chooses to use hypophosphorous acid, the pH can be controlled by addition of an alkaline earth metal hydroxide or carbonate to precipitate out the orthophosphite and adjust pH. Here too, the stress of the nickel alloy deposit is minimized.

In view of the above consideration, i.e, the use of, for example, calcium to control the orthophosphite in the bath, in a preferred embodiment of one aspect of this invention, part of the nickel is introduced as a water soluble nickel salt of a counter ion that forms a soluble salt with the cation used to precipitate the orthophosphite from the bath. As has been described, use of nickel sulfate in a bath where an alkaline earth metal is used to remove the orthophosphite results in the formation of an alkaline earth metal sulfate; these are insoluble and create an undesirable sludge in the bath. It has been found that introduction of the nickel cation as the salt of an anion that forms a soluble alkali or alkaline earth metal salt reduces the buildup of sludge and allows for the continuous removal of orthophosphite and the continuous operation of the bath.

Thus, although the nickel can be introduced solely as the salt of hypophosphorous acid, the nickel ion is preferably also introduced as the salt of an alkyl sulfonic acid of formula:

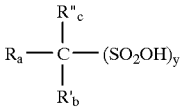

where:

a, b and c each independently is an integer from 1 to 3 y is an integer from 1 to 3

R" is hydrogen, or lower alkyl that is unsubstituted or substituted by oxygen, Cl, F, Br or I, $CF_3$ or —$SO_2OH$ R and R' each independently is hydrogen, Cl, F, Br, I, $CF_3$ or lower alkyl that is unsubstituted or substituted by oxygen, Cl, F, Br, I, $CF_3$ or—$SO_2OH$ and the sum of a+b+c+y=4

Representative sulfonic acids include the alkyl monosulfonic acids such as methanesulfonic, ethanesulfonic and propanesulfonic acids and the alkyl polysulfonic acids such as methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid and 1,3-propylene disulfonic acid.

Because of availability, the sulfonic acids of choice are methanesulfonic and methanedisulfonic acids. Nickel salts of methanesulfonic acid are particularly preferred and the entire nickel ion content of the electroless nickel plating bath can be supplied in the form of the hypophosphite and alkyl sulfonic acid salts.

In conventional electroless nickel baths the operating nickel ion concentration is typically from about 1 up to about 18 grams per liter (g/l) with concentrations of from about 3 to about 9 g/l being preferred. Stated differently, the concentration of nickel cation will be in the range of from 0.02 to about 0.3 moles per liter, preferably in the range of from about 0.05 to about 0.15 moles per liter.

The hypophosphite reducing agent employed in the solutions for baths according to this invention will primarily be nickel hypophosphite and hypophosphorous acid.

In the replenishing solution, a source can be calcium hypophosphite which further serves to minimize the extraneous introduction of sodium cations into the reaction bath and provides an additional source of calcium for facilitating the formation of the desired calcium orthophosphite.

The amount of the reducing agent employed in the plating bath is at least sufficient to stoichiometrically reduce the nickel cation in the electroless nickel reaction to free nickel metal and such concentration is usually within the range of from about 0.05 to about 1.0 moles per liter. Stated differently, the hypophosphite reducing ions are introduced to provide a hypophosphite ion concentration of about 2 up to about 40 g/l, preferably about 12 to 25 g/l with a concentration of about 15 to about 20 g/l being optimum. The specific concentration of the nickel ions and hypophosphite ions employed will vary depending upon the relative concentration of these two constituents in the bath, the particular operating conditions of the bath and the types and concentrations of other bath components present. As a conventional practice the reducing agent will be replenished during the reaction.

Nickel hypophosphite is a highly efficient way to introduce nickel and hypophosphite to an electroless nickel plating system since both are consumed and by-product orthophosphite can be removed by addition of, e.g., calcium hydroxide to adjust the pH, or calcium hypophosphite.

While the foregoing discussion contemplates forming a bath from the start, it is possible to rapidly convert an existing nickel sulfate bath. This is accomplished by incorporating an alkaline earth metal salt of an alkyl sulfonic acid (e.g., calcium methanesulfonate) in an amount to precipitate the alkaline earth metal sulfate and leave the alkyl sulfonate as the nickel counter ion. Thereafter, calcium hypophosphite is slowly added to precipitate the orthophosphite.

The solutions according to this invention may contain in addition to the sources of nickel and hypophosphite other conventional bath additives such as buffering, complexing, chelating agents, as well as accelerators, stabilizers, inhibitors and brighteners.

The temperature employed for the plating bath is in part a function of the desired rate of plating as well as the composition of the bath. Typically the temperature is within the conventional ranges of from about 25° C. to atmospheric boiling at 100° C., although in a preferred embodiment the particular plating solution temperature is usually about 90° C. and within the range of from about 30° to 95° C.

The electroless nickel plating baths can be operated over a broad pH range including the acid side and the alkaline side at a pH of from about 4 up to about 10. For an acidic bath, the pH can generally range from about 4 up to about 7 with a pH of about 4.3 to about 5.2 being preferred. For an alkaline bath, the pH can range from about 7 up to about 10 with a pH range of from about 8 to about 9 being preferred. Since the bath has a tendency to become more acidic during its operation due to the formation of hydrogen ions, the pH is periodically or continuously adjusted by adding bath soluble and compatible alkaline substances such as alkali metal and ammonium hydroxides, carbonates and bicarbonates. Stability of the operating pH can also be provided by the addition of various buffer compounds such as acetic acid, propionic acid, boric acid or the like in amounts up to about 30 g/l with amounts of about 4 to about 12 g/l being typical.

In practicing the process of this invention the specific mode or procedure employed is dependent upon whether the removal of orthophosphite is performed as a batch or, according to a preferred embodiment of this invention, as a continuous process.

In general, however, when the conventional plating operation has been continued under appropriate electroless nickel plating conditions, the plating is terminated by withdrawal of the substrate being plated and an alkali metal or alkaline earth metal cation such as calcium is added to control the concentration of orthophosphite.

Removal of the insoluble alkali metal or alkaline earth metal phosphite formed by the addition of the alkali metal or alkaline earth metal cation may be achieved using appropriate separational techniques such as decanting, centrifuging or filtration. Filtration, however, because of the ease of operation is a preferred procedure and may be performed by passing the plating solution through an appropriate filter medium having a pore size approximate to entrap the insolubilized phosphite salt. Filters having capture size in the range below about 5 microns are suitable for such purpose.

The point of termination or duration of the plating will depend upon several factors such as the quantity of nickel metal desired for the deposit, plating rate, temperature and bath composition.

However, it is particularly preferred and advantageous to permit the bath to be operated on a continuous basis. In conducting a continuous process for the electroless nickel plating baths formed from solutions of this invention, the plating bath containing the desired bath components is maintained in a suitable plating vessel or bath zone such as a glass or plastic tank. The plating is allowed to proceed upon a suitable substrate under electroless nickel plating conditions. A portion of the bath is continuously withdrawn from the plating vessel and passed by appropriate pumping means to a separation zone such as a vessel or tank. The rate of withdrawal from the plating vessel may be controlled by monitoring the phosphite concentration buildup and the withdrawal rate increased or decreased to maintain the desired phosphite concentration generally below about 0.4 moles per liter. The concentration of orthophosphite in the bath is controlled by the addition of alkali metal or alkaline earth metal cations to the portion which has been removed, which then precipitates as an insoluble alkali metal or alkaline earth metal orthophosphite. The portion of the bath containing the suspended insoluble alkali metal or alkaline earth metal phosphite is passed to a removal zone where the insoluble phosphite is separated from the bath solution. Such removal zone may appropriately be a filter of conventional design having the ability to separate particle sizes below about 0.5 microns on a continuous basis. The treated portion of the bath is then continuously returned to the bath zone to continuously add back to the bath solution replenished bath solution that is substantially free of phosphite anions.

The continuous process may be thus operated over long periods of time with the conventional replenishment of the sources of the nickel and hypophosphite plating materials to achieve a bath capable of long plating runs.

The improvements described above had reference to the operation of a bath formulated from the start with the necessary ingredients. However, one can use the materials described herein to replenish a standard nickel sulfate bath and realize the benefits, albeit slowly and over a period of time. Thus, nickel in a standard bath can be replenished with the nickel salt of an alkylsulfonic acid; the alkylsulfonic acid is compatible with the other ingredients in the bath. At the same time the hypophosphite concentration can be replenished with nickel hypophosphite or a combination of nickel hypophosphite and nickel methanesulfonate.

The following Examples are offered to illustrate the electroless nickel plating baths using the solutions of this invention and the modes of carrying out such invention:

EXAMPLE 1

A. Production of Nickel Hypophosphite

Nickel carbonate is dissolved in hypophosphorous acid at room temperature until a saturated solution of $NiH_2PO_2$ is formed. Analysis indicates that the supernatant liquid contained 35 grams per liter of nickel.

B. Production of Nickel Methanesulfonate

A saturated solution of nickel methanesulfonate at room temperature is prepared by dissolving nickel carbonate into methanesulfonic acid. The solution contains 134 grams per liter of nickel.

C. Comparative Solutions

In each of the following the contents of Beaker B are mixed with the contents of Beaker A which contains a saturated solution of nickel hypophosphite and an amount of nickel hypophosphite crystals. The contents are mixed to determine the effect on the concentration of Ni ions in the resulting solution. The following results are observed:

TABLE I

| | Beaker A ml | Beaker B | $[Ni]^{+2}$ Theory g/l | $[Ni]^{+2}$ Measured g/l | Free Acid meq/g |
|---|---|---|---|---|---|
| C.1 | 30 | — | 35 | 35.2 | 0.369 |
| C.2 | 25 | 5 ml* | 51.66 | 49.91 | 0.298 |
| C.3 | 20 | 10 ml* | 68.0 | 68.51 | 0.233 |
| C.4 | 15 | 15 ml* | 84.6 | 86.59 | 0.148 |
| C.5 | 30 | 3 gms NaMSA | — | 35.53 | 0.360 |
| C.6 | 30 | 8.4 gms NaMSA | — | 34.74 | 0.418 |
| C.7 | 25 | 1 ml MSA | — | 42.21 | 0.476 |

*of a saturated solution of nickel methanesulfonate

As is seen, the amount of nickel ion in solution more than doubles, from about 35 g/l to about 85, when nickel methanesulfonate is present in the solution.

Examples C.5 and C.6 show that the addition of NaMSA had no effect on the concentration of Ni ion in solution.

Example C.7 shows that more nickel can be brought into solution by adding an acid which forms a more soluble salt than $Ni(H_2PO_2)_2$ Although other acids (HCl, $H_2SO_4$, $H_3PO_4$, etc.) may increase the solubility of $Ni(H_2PO_2)_2$ they are not recommended in electroless nickel systems. Sulfuric acid and phosphoric acid will cause the formation and precipitation of excess sludge when calcium is added to remove orthophosphite. Chloride (from HCl) will increase the stress on the coating. Thus, it is only the alkylsulfonic acids that are compatible with the bath chemistry and the proposed recycle methods.

From Examples C.2–C.4, it is seen that it is possible to formulate a make-up and replenishment solution with a nickel ion concentration greater than 75 g/l. Note that the amount of free acid is approximately the same, indicating no change in metal salt equilibrium; this indicates that the solubility of $Ni(H_2PO_2)_2$ solution has not been changed.

The method of forming the $Ni(MSA)_2$:$Ni(H_2PO_2)_2$ solution is not critical, can be done in a variety of ways and is dependent only on individual preference. Thus, one can combine MSA and $H_3PO_2$ and add $NiCO_3$; alternatively, one can combine MSA and $H_3PO_2$ and electrolytically dissolve a nickel anode, using the methods described in U.S. Pat. No. 5,522,972. Alternatively, one could combine $H_3PO_2$ and MSA and dissolve nickel powder, with or without an oxidizing agent.

EXAMPLE 2

Preparation of Stock Solutions, Make-up Solution and Replenishing Solution

A. Stock Nickel Methanesulfonate-Hypophosphite Solution is prepared by mixing together 150 g/l $NiCO_3$, 160 ml/l $H_3PO_2$ and 187 ml MSA and then adding sufficient Cd(OEs)2 and Thiourea to obtain a solution having the following composition.

| | |
|---|---|
| $Ni^{+2}$ | 75 g/l |
| $H_2PO_2$ | 80 g/L |
| methanesulfonate | 133 g/l |
| $Cd(OEs)_2$ | 31 ppm |
| Thiourea | 25 ppm |

B. A Stock Chelant and Hypophosphite Solution (Stock Make-up) was prepared to have the following composition:

| | |
|---|---|
| $NaH_2PO_2$ | 131 g/l |
| Lactic Acid | 200 ml/l |
| Acetic Acid | 100 ml/l |
| Propionic Acid | 15 ml/l |
| Glycine | 35 g/l |
| NaOH | 125 g/l |
| $Pb(NO_3)_2$ | 10 ppm |

C. A Stock Replenishment Hypophosphite Solution was prepared to have the following composition:

| | |
|---|---|
| Lactic Acid | 50 ml/l |
| Acetic Acid | 25 ml/l |
| Propionic Acid | 35 ml/l |
| Glycine | 15 g/l |
| NaOH | 20 g/l |
| $NH_3$ | |
| $Pb(NO_3)_2$ | 125 ppm |
| $Cd(OEs)_2$ | 100 ppm |

To prepare the electroless nickel bath, sufficient volumes of the Stock Nickel Methanesulfonate-Hypophosphite Solution and Stock Make-up Solution are added to water to result in a bath having 8% v/v Stock Nickel Methanesulfonate-Hypophosphite Solution and 15% v/v Stock Make-up Solution.

During replenishment of the electroless nickel bath, sufficient volumes of the Stock Nickel Methanesulfonate-Hypophosphite Solution and Stock Replenishment Hypophosphite Solution are added for every metal turnover (MTO) to result in the replenished bath containing 8% v/v of each per liter of bath.

EXAMPLE 3

Plating Using a Nickel Methanesulfonate: Hypophosphite Solution

A make-up electroless nickel solution is prepared by diluting 80 ml of the Stock Nickel Methanesulfonate-Hypophosphite Solution and 150 ml of the Stock Make-up Solution to 1000 ml. The solution pH is 4.79 and is heated to 90° C. All plating was done in a one liter glass beaker.

Prior to plating, the steel coupons are cleaned in a mild alkaline cleaner followed by immersion activation in 10% hydrochloric acid solution at room temperature for five seconds. The coupons are weighed before and after plating.

Coupon #1

Weight before plating—15.4597 gms.

Weight after plating—17.4961 gms.

Total weight of deposit—2.0364 gms.

(Represents approximately ⅓ of a metal turnover)

After Coupon 1 is removed, the nickel in the bath is replenished by adding 26 ml of stock nickel hypophosphite solution and 27 ml of the stock hypophosphite replenishment solution to the plating-solution. Only one/third of the amount needed to replenish the nickel after a complete metal turnover is added. The temperature drops from 90° C. to 89° C.

Coupon #2

Weight before plating—15.7418 gms.

Weight after plating—18.1369 gms.

Total weight of deposit—2.3951 gms.

(Represents approximately ⅓ of a metal turnover)

After Coupon 2 is removed, the nickel in the bath is replenished by adding 26 ml of stock nickel hypophosphite solution and 26 ml of the stock hypophosphite replenishment solution to the plating solution. The temperature remains at 90° C.

Coupon #3

Weight before plating—15.2977 gms.

Weight after plating—17.3476 gms.

Total weight of deposit—2.0499 gms.

(Represents approximately ⅓ of a metal turnover)

After Coupon 3 is removed, the nickel in the bath is replenished by adding 26 ml of stock nickel hypophosphite solution and 226 ml of the stock hypophosphite replenishment solution to the plating solution. The temperature drops from 91° C. to 90° C.

At the end of plating, the solution volume increased from 1000 ml to approximately 1050 ml.

I claim:

1. A makeup or replenishing aqueous solution for an electroless nickel bath, the solution comprised of Ni methane sulfonate, and $Ni(H_2PO_2)_2$, wherein the Ni cation concentration is greater than 36 grams/liter.

2. A makeup or replenishing solution for an electroless nickel bath, the solution comprised of Ni cation, hypophosphite anion and alkyl sulfonate anion, wherein the Ni cation concentration is greater than 36 grams/liter.

3. The solution of claim 2 wherein the alkyl sulfonate anion is derived from an alkyl sulfonic acid of formula:

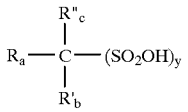

where:

a, b and c each independently is an integer from 1 to 3 y is an integer from 1 to 3

R" is hydrogen, or lower alkyl that is unsubstituted or substituted by oxygen, Cl, F, Br or I, $CF_3$ or —$SO_2OH$ R and R' each independently is hydrogen, Cl, F, Br, I, $CF_3$ or lower alkyl that is unsubstituted or substituted by oxygen, Cl, F, Br, I, $CF_3$ or —$SO_2OH$ and the sum of a+b+c+y=4.

4. The solution of claim 2 wherein the alkyl sulfonate anion is derived from an alkyl monosulfonic acid or an alkyl polysulfonic acid.

5. The solution of claim 4 wherein the alkyl sulfonic acid is methanesulfonic acid, ethanesulfonic acid, propanesulfonic acid, methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid or 1,3-propylene disulfonic acid.

6. The solution of claim 4 wherein the alkyl sulfonic acid is methanesulfonic acid or methanedisulfonic acid.

7. The solution of claim 1 wherein the Ni cation is introduced by a soluble salt whose anion forms a soluble salt with an alkali metal or alkaline earth metal.

8. The solution of claim 7 wherein the nickel salt is nickel hypophosphite or nickel alkane sulfonate.

9. A makeup or replenishing solution for an electroless nickel bath, the solution comprised of soluble Ni salt, hypophosphorous acid, alkyl sulfonic acid, and soluble alkali metal or alkaline earth metal compound, wherein the alkali metal or alkaline earth metal forms an insoluble orthophosphite salt, wherein Ni concentration is greater than 36 grams/liter.

10. A makeup or replenishing solution for an electroless nickel bath, the solution comprised of Ni hypophosphite, Ni alkyl sulfonate, and calcium hypophosphite, wherein Ni concentration is greater than 36 grams/liter.

* * * * *